US006701100B2

(12) United States Patent
Tamiya et al.

(10) Patent No.: US 6,701,100 B2
(45) Date of Patent: Mar. 2, 2004

(54) IMAGE FORMING APPARATUS INCLUDING AN IMAGE CARRIER AND A POLARIZATION UNIFORMING STRUCTURE

(75) Inventors: Takahiro Tamiya, Tokyo (JP); Shinichi Namekata, Yokohama (JP); Shigeru Watanabe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 151 days.

(21) Appl. No.: 10/052,433

(22) Filed: Jan. 23, 2002

(65) Prior Publication Data

US 2002/0098011 A1 Jul. 25, 2002

(30) Foreign Application Priority Data

Jan. 23, 2001 (JP) ..... 2001-014654
Jan. 23, 2001 (JP) ..... 2001-014665

(51) Int. Cl.[7] ..... G03G 15/16
(52) U.S. Cl. ..... 399/66; 399/302
(58) Field of Search ..... 399/66, 101, 302, 399/308, 314, 127

(56) References Cited

U.S. PATENT DOCUMENTS

| | | | | |
|---|---|---|---|---|
| 5,599,645 | A | 2/1997 | Tamiya et al. | |
| 5,640,645 | A | 6/1997 | Namekata et al. | |
| 5,740,492 | A | 4/1998 | Deki et al. | |
| 5,890,030 | A | 3/1999 | Namekata et al. | |
| 5,983,060 | A * | 11/1999 | Namekata et al. | 399/297 |
| 6,061,543 | A | 5/2000 | Kayahara et al. | |
| 6,134,416 | A | 10/2000 | Tamiya | |
| 6,163,661 | A | 12/2000 | Namekata et al. | |
| 6,173,148 | B1 * | 1/2001 | Matsuda et al. | 399/310 |
| 6,184,910 | B1 | 2/2001 | Sasaki et al. | |
| 6,212,351 | B1 | 4/2001 | Kawagoe et al. | |
| 6,269,228 | B1 | 7/2001 | Kayahara et al. | |
| 6,298,212 | B1 * | 10/2001 | Kono et al. | 399/302 |
| 6,308,019 | B1 * | 10/2001 | Miyashiro et al. | 399/66 |
| 6,330,407 | B1 * | 12/2001 | Tsukida et al. | 399/66 |
| 6,430,379 | B1 * | 8/2002 | Takahashi et al. | 399/44 |

FOREIGN PATENT DOCUMENTS

| | | | | |
|---|---|---|---|---|
| JP | 6-194967 | | 7/1994 | |
| JP | 9-204107 | | 8/1997 | |
| JP | 11-231687 | | 8/1999 | |
| JP | 11258927 A | * | 9/1999 | G03G/15/16 |
| JP | 200122507 A | * | 4/2000 | G03G/21/14 |

OTHER PUBLICATIONS

U.S. patent application Ser. No. 09/828,851, filed Apr. 10, pending.

(List continued on next page.)

*Primary Examiner*—Robert Beatty
(74) *Attorney, Agent, or Firm*—Oblon, Spivak, McClelland, Maier & Neustadt, P.C.

(57) ABSTRACT

An image forming apparatus of the present invention includes a latent image forming device for forming a latent image on an image carrier and a developing device for developing the latent image with toner to thereby form a corresponding toner image. The surface of an intermediate image transfer body is movable and includes an high-resistance layer having a volume resistivity of $10^{10}$ Ω·cm or above. A primary image transferring device transfers the toner image from the image carrier to the intermediate image transfer body. Secondary image transferring device transfers the toner image from the intermediate image transfer body to a sheet. A polarization uniforming device uniforms, at the beginning of an image forming operation, polarization left in the high-resistance layer while preserving the polarity of the polarization after the surface of the intermediate image transfer body has started moving, but before the toner image is transferred from the image carrier to the secondary image transfer body.

22 Claims, 14 Drawing Sheets

OTHER PUBLICATIONS

U.S. patent application Ser. No. 09/947,391, filed Sep. 7, pending.
U.S. patent application Ser. No. 10/155,133, filed May 28, pending.
U.S. patent application Ser. No. 09/900,046, filed Jan. 23, pending.
U.S. patent application Ser. No. 10/424,077, Suzuki et al., filed Apr. 28, 2003.

* cited by examiner

Fig. 6

| SYMBOL | BIAS FOR INITIAL SATURATION VO[V] | BIAS FOR DISCHARGE V1[V] |
|---|---|---|
| ◆ | +250 | −250 |
| ◀ | +500 | −250 |
| ◇ | +250 | 0(GND) |
| △ | +500 | 0(GND) |

*Fig. 9*

| | PRE-BIAS ($\mu$A) | RESIDUAL IMAGE RANK | |
|---|---|---|---|
| | | POSITION A | POSITION B |
| COMPARATIVE EXAMPLE | – | 1.5 | 3 |
| EXAMPLE | 5 | 4 | 3 |
| | 20 | 5 | 3.5 |
| | 30 | 5 | 3.5 |
| | 35 | 5 | 3.5 |
| | 40 | 5 | 4 |
| | 50 | 5 | 5 |

Fig. 15

| | POST-BIAS ($\mu$A) | RESIDUAL IMAGE RANK |
|---|---|---|
| COMPARATIVE EXAMPLE | – | 2 |
| EXAMPLE | 5 | 3 |
| | 20 | 3 |
| | 30 | 4 |
| | 30 | 4 |
| | 40 | 3.75 |
| | 50 | 4 |
| | 60 | 3.5 |

IMAGE FORMING APPARATUS INCLUDING AN IMAGE CARRIER AND A POLARIZATION UNIFORMING STRUCTURE

BACKGROUND OF THE INVENTION

1. Field of the Invention

The present invention relates to a copier, printer, facsimile apparatus or similar image forming apparatus of the type including an intermediate image transfer body intervening between an image carrier and a sheet or recording medium as to image transfer.

2. Description of the Background Art

An image forming apparatus of the type described is implemented as, e.g., a color copier or a color laser printer in which toner images of different colors are transferred from an image carrier to an intermediate image transfer body one above the other (primary transfer) and then collectively transferred to a sheet (secondary transfer). The intermediate image transfer body is usually formed of a high-molecular material having a preselected mechanical characteristic and a preselected electrostatic characteristic. The problem with this type of image forming apparatus is that toner scatters around a toner image transferred from the image carrier to the intermediate image transfer body.

To obviate the scattering of the toner at the time of primary transfer, the intermediate image transfer body may include a high-resistance layer having a volume resistivity of $10^{10}$ Ω·cm or above. Such an intermediate image transfer body allows the potential of a latent image to be transferred from the image carrier thereto and held thereon together with the toner image. The transferred potential prevents the toner from scattering around the toner image transferred to the intermediate image transfer body.

However, the intermediate image transfer body with the high-resistance layer brings about the following problem. When a plurality of toner images are transferred to the same area of the intermediate image transfer body one above the other, the history of potential contrast images remain in the high-resistance layer in accordance with the presence/absence of toner on the image carrier and sheet. A potential contrast image left in the high-resistance layer is difficult to discharge and is apt to remain up to the next image forming cycle. As a result, when a highlight image or similar image with low image density (ID) is formed later, a residual image corresponding to the potential contrast image is likely appear in the low ID image.

We found by a series of researches and experiments that even when the intermediate image transfer body was discharged from the outside, a potential distribution remained in the body and caused a residual image to appear in an image later. Further, the potential distribution was apt to remain in the high-potential layer, which formed part of a laminate structure.

The residual charge in the intermediate image transfer body is difficult to remove with charging means that applies a DC voltage opposite to the conventional image transfer bias to the intermediate image transfer body. If the size of the DC voltage is increased, then the residual charge in the intermediate image transfer body may be discharged to a certain degree. However, such a DC voltage is likely to damage the surface of the intermediate image transfer body to a critical degree. While an AC voltage with a great amplitude may effectively discharge the residual charge, it increases the current to 1 mA or so, which is greater than several microamperes to several ten microamperes of the DC voltage. This is also likely to damage the surface of the intermediate image transfer body, and moreover increases the cost.

Particularly, as for the intermediate image transfer body with the high-resistance layer, the conventional discharging means described above simply causes the surface potential of the body to vary and cannot directly apply a bias to the high-resistance layer. It is therefore difficult to discharge the high-resistance layer with the conventional discharging means. Moreover, the conventional discharging means is apt to critically damage the surface layer.

Technologies relating to the present invention are disclosed in, e.g., Japanese Patent Laid-Open Publication Nos. 6-194967, 9-204107 and 11-231687.

SUMMARY OF THE INVENTION

It is a first object of the present invention is to provide an image forming apparatus capable of surely obviating, even when an intermediate image transfer body with a high-resistance layer is used, a residual image ascribable to polarization, which is left in the high-resistance layer, before primary image transfer.

It is a second object of the present invention to provide an image forming apparatus capable of surely obviating, even when an intermediate image transfer body of the kind is used, a residual image ascribable to polarization, which is left in the high-resistance layer, after an image forming operation.

An image forming apparatus of the present invention includes an image carrier, a latent image forming device for forming a latent image on the image carrier, and a developing device for developing the latent image with toner to thereby form a corresponding toner image. An intermediate image transfer body has a movable surface and includes an high-resistance layer whose volume resistivity is $10^{10}$ Ω·cm or above. A primary image transferring device transfers the toner image from the image carrier to the intermediate image transfer body. A secondary image transferring device transfers the toner image from the intermediate image transfer body to a recording medium. A polarization uniforming device uniforms, at the beginning of an image forming operation, polarization left in the high-resistance layer while preserving its polarity after the surface of the intermediate image transfer body has started moving, but before the toner image is transferred from the image carrier to the secondary image transfer body.

BRIEF DESCRIPTION OF THE DRAWINGS

The above and other objects, features and advantages of the present invention will become more apparent from the following detailed description taken with the accompanying drawings in which:

FIG. 6 is a table listing various biases for initial saturation polarization and discharging biases;

FIG. 9 is a table listing residual image ranks determined at two points on an image by varying pre-bias unique to the illustrative embodiment;

FIG. 15 is a table comparing the alternative embodiment and a comparative example with respect to residual image.

DESCRIPTION OF THE PREFERRED EMBODIMENTS

Figure 1:
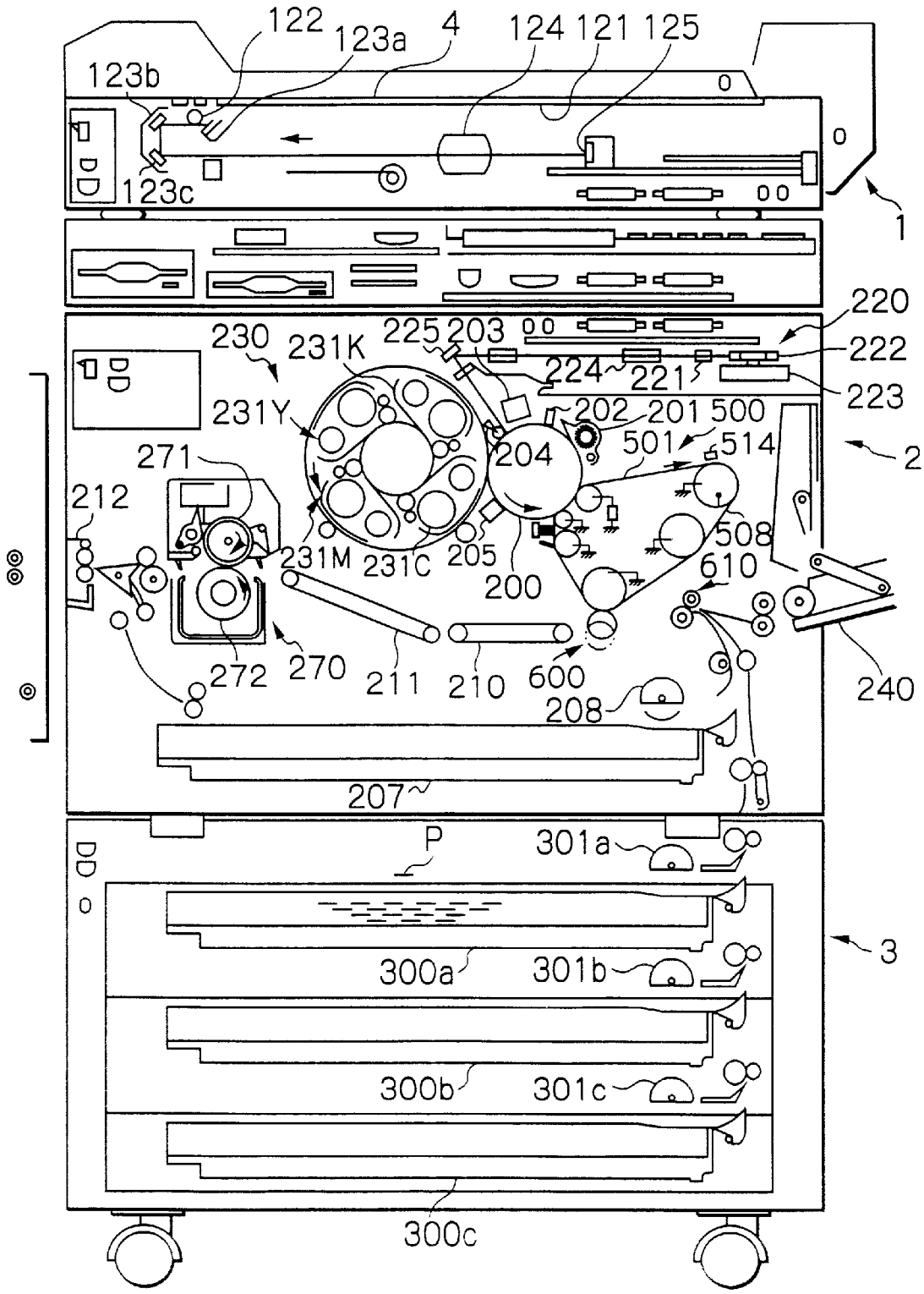
FIG. 1 is a front view showing a color copier embodying the present invention.

Referring to FIG. 1 of the drawings, an image forming apparatus embodying the present invention is shown and implemented as an electrophotographic color copier by way of example. This embodiment is mainly directed toward the first object stated earlier. As shown, the copier is generally made up of a color scanner or color image reading device 1, a printer or color image recording device 2, and a sheet bank 3.

The color scanner 1 includes a lamp 122, mirrors 123*a*, 123*b* and 123*c*, and a lens 124. While the lamp 122 illuminates a document 4 laid on a glass platen 121, the resulting reflection representative is focused on a color sensor 125 via the mirrors 123*a* through 123*c* and lens 124. The color sensor 125 reads color image information color by color, e.g., on a R (red), G (green) and B (blue) basis while outputting a corresponding electric image signal. Specifically, the color sensor 125 is made up of R, G and B color separating means and a CCD (Charge Coupled Device) array or similar photoelectric transducer and reads R, G and B image data separated by the separating means at the same time. An image processing section, not shown, converts the R, G and B image signals to Bk (black), C (cyan), M (magenta) and Y (yellow) color image data.

More specifically, in response to a scanner start signal synchronous to the operation of the color printer 2, the color scanner 1 causes the lamp 122 and mirrors 123*a* through 123*c* to move in a direction indicated by an arrow in FIG. 1 while scanning the document 4. By one time of scanning, the color scanner 1 outputs four different color image data. The color printer 2 sequentially forms toner images of four different colors and superposes them on each other to thereby produce a four-color or full-color toner image.

The color printer 2 includes a photoconductive drum or image carrier 200, an optical writing unit 220, developing means implemented as a revolver 230, an intermediate image transferring unit 500, a secondary image transferring device 600, and a fixing device 270. The drum 200 is rotatable counterclockwise, as indicated by an arrow in FIG. 1. Arranged around the drum 200 are a drum cleaner 201, a discharge lamp 202, a charger 203, a potential sensor 204 and a density pattern sensor 205 as well as the intermediate image transfer unit 500 and secondary image transferring device 600. In addition, the revolver 230 is located such that one of its developing sections, which will be described specifically later, adjoins the drum 200. The charger 203 and optical writing unit 220 constitute latent image forming means.

The writing unit 200 converts the color image data output from the color scanner 1 to a corresponding optical signal and scans the drum 200 with the optical signal to thereby form a latent image, which is representative of the document image. The writing unit 220 includes a semiconductor laser or light source 221, a laser driver, not shown, a polygonal mirror 222, a motor 223 for rotating the mirror 222, an f/θ lens 224, and a mirror 225.

The revolver 230 includes a Bk developing section 231K, a C developing section 231C, an M developing section 231M, and a Y developing section 231Y. A driveline, not shown, causes the revolver 230 to revolve counterclockwise, as indicated by an arrow in FIG. 1. A bias power supply, not shown, applies a DC voltage biased by an AC voltage Vac to a sleeve, which is included in each developing section, as a bias for development. The bias biases the sleeve to a preselected potential relative to a base included in the drum 200.

In the illustrative embodiment, when the copier body is in a stand-by state, the Bk developing unit 231 of the revolver 230 is positioned upstream of a developing position in the direction of rotation of the revolver 230 by an angle of 30°. At the developing position, the revolver 230 faces the drum 200. On the start of a copying cycle, the color scanner 1 starts outputting Bk color data at a preselected timing. The color printer 2 starts forming a latent image in accordance with the Bk color data. Let the latent image derived from the Bk color data be referred to as a Bk latent image hereinafter. This is also true with the other colors M and Y.

Before the leading edge of the Bk latent image arrives at the developing position, the revolver 230 rotates to locate the Bk developing section 231 at the developing position while causing a Bk sleeve included in the Bk developing section 231 to start rotating. In this condition, the Bk developing section 231 develops the Bk latent image with Bk toner. As soon as the trailing edge of the Bk latent image moves away from the developing position, the revolver 230 again revolves to bring the next developing section thereof to the developing section. This rotation completes at least before the leading edge of the next latent image arrives at the developing section.

Figure 2:
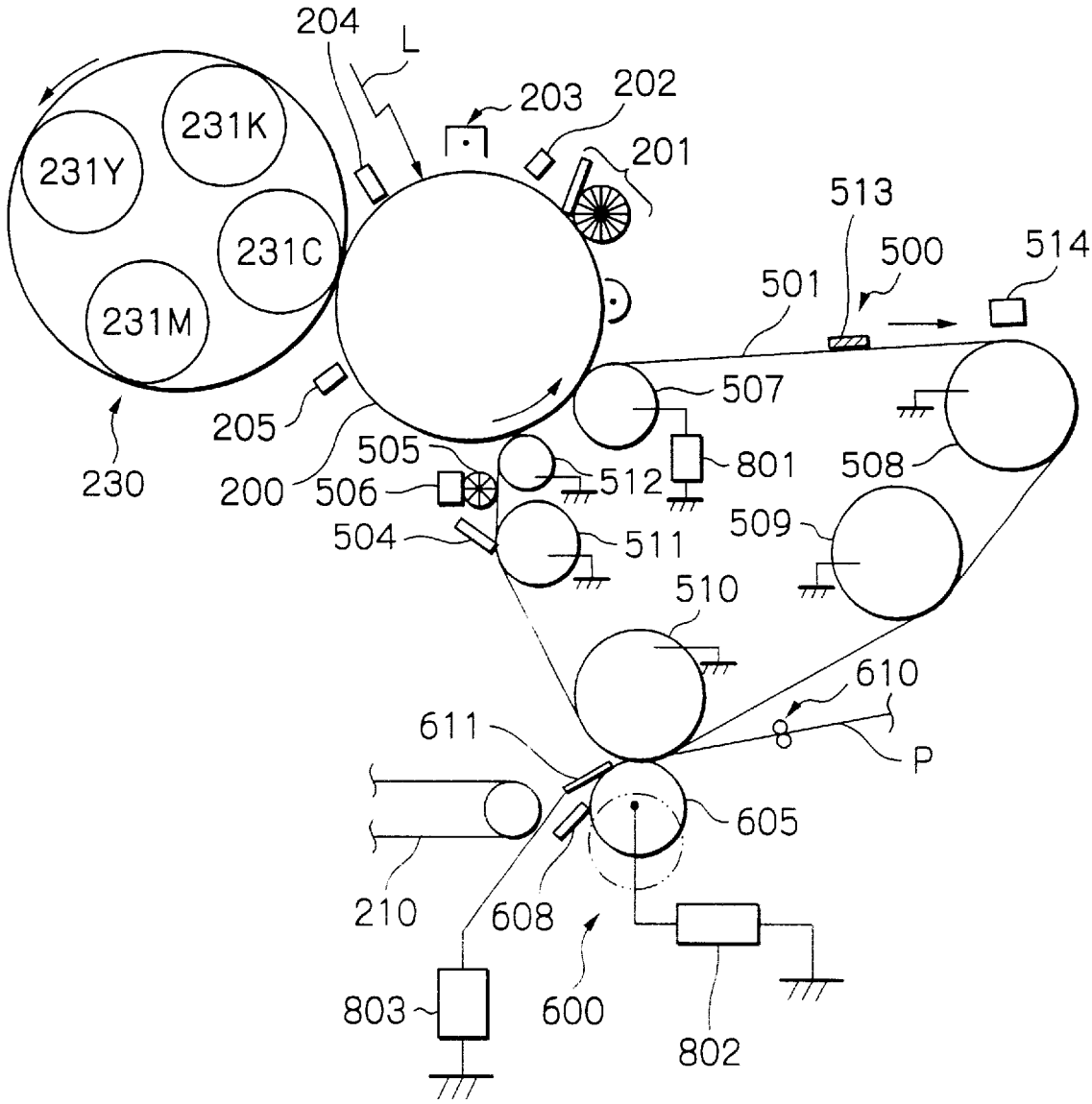
FIG. 2 is a fragmentary front view of the color copier.

FIG. 2 shows the intermediate image transferring unit 500 specifically. As shown, an intermediate image transfer belt (simply belt hereinafter) 501 is passed over a plurality of rollers. Arranged around the belt 501 are a bias roller 605, a belt cleaner 504, and a brush 505. The bias roller 605 constitutes a secondary image transfer member (secondary image transfer charge applying means) included in a secondary image transferring device 600. The belt cleaner or intermediate image transfer body cleaning means 504 cleans the belt 501. The brush or lubricant coating means 505 coats a lubricant on the belt 501.

A mark, not shown, is positioned on the inner surface of the outer surface of the belt 501 for allowing the position of the belt 501 to be sensed. The mark should preferably be positioned on the inner surface of the belt 501 because the mark positioned on the outer surface of the belt 501 must avoid a belt cleaning blade 504 and therefore makes layout difficult. An optical sensor or mark sensor 514 is positioned between a bias roller 507 and a drive roller 508 over which the belt 501 is passed.

The belt 501 is passed over a bias roller or primary image transferring means 507, a tension roller 509 and rollers 510, 511 and 512 as well as over the bias roller 507 and drive roller 508. The rollers 510 and 511 join in secondary image transfer and belt cleaning, respectively. The roller 512 is used to sense a feedback current, as will be describe specifically later. The rollers other than the roller 507 are connected to ground.

A power supply 801 assigned to primary image transfer applies to the bias roller 507 a bias for primary image transfer, which is a current or a voltage controlled to a preselected size matching with the number of toner image to be superposed. In the illustrative embodiment, constant current control is effected to apply a constant bias to the bias roller 507 without regard to the electric resistance of the belt 501. Also, control is effected such that a current flowing from the bias roller 507 to the roller 512 via the belt 501 remains constant (e.g. 22 $\mu$A).

A motor, not shown, causes the belt 507 to move in a direction indicated by an arrow in FIG. 2 via the drive roller 508. The belt 501 is formed of a conductor or an insulator and has a laminate structure, which will be described later. The belt 501 has a size greater than the maximum sheet size applicable to the copier in order to superpose toner images of different colors.

A moving mechanism or moving means, not shown, selectively moves the bias roller 605 for secondary image transfer into or out of contact with part of the belt 501 passed over the roller 510. A sequence controller, which will be described later, controls the moving mechanism via a clutch, which will also be described later. The moving means may be implemented by a solenoid, if desired. A constant-current power supply 802 for secondary image transfer applies a bias, which is a preselected current, to the bias roller 605. The sequence controller monitors the current of the secondary image transfer bias.

The bias roller 605 may be provided with a conductive high-molecular film having an electric resistance of $10^4\Omega$ to $10^8\Omega$ on its surface and may have a diameter of 30 mm. Likewise, the roller 510 may be provided with a conductive high-molecular film on its surface and may have a diameter of 40 mm.

A registration roller pair 610 (see FIG. 1) feeds a sheet or recording medium P to a nip between the bias roller 605 and the roller 510 at a preselected timing. A cleaning blade or cleaning means 608 is held in contact with the bias roller 605 in order to remove toner and impurities deposited on the bias roller 605.

In operation, when an image forming cycle begins, the motor mentioned earlier rotates the drum 200 counterclockwise. In this condition, a Bk, C, an M and a Y toner image are sequentially formed on the drum 200. The drive roller 508 causes the belt 501 to move clockwise. The bias applied to the bias roller 507 causes the Bk, C, M and Y toner images to be sequentially transferred from the drum 200 to the belt 501 one above the other (primary image transfer). As a result, a full-color image is completed on the belt 501.

How the Bk toner image, for example, is formed will be described with reference to FIG. 2. The charger 203 uniformly charges the surface of the drum 200 to a preselected potential with a negative charge. The optical writing unit 220, FIG. 1, scans the charged surface of the drum 200 with a laser beam by raster scanning in accordance with the Bk image signal on the basis of a signal representative of the mark of the belt sensed. The scanned or exposed portion of the drum 200 loses the charge by an amount corresponding to the quantity of incident light, so that the Bk latent image is formed as a potential distribution. The Bk developing unit 231 develops the Bk latent image with Bk toner deposited on the Bk sleeve. More specifically, the Bk toner deposits on the exposed portion of the drum 200, but does not deposit on the unexposed portion where the charge is left, forming a Bk toner image corresponding to the Bk latent image.

The Bk toner image is transferred from the drum 200 to the belt 500, which is moving at a constant speed in contact with the drum 200. The drum cleaner 201 removes some toner left on the drum 200 after the primary image transfer to thereby prepare the drum 200 for the next image forming cycle. After the formation of the Bk toner image, the color scanner 220 starts reading Y image data out of the document 4, FIG. 1. The writing unit 220 forms a Y latent image on the surface of the drum 200 in accordance with the resulting Y image data.

The revolver 230 revolves to locate the Y developing section 231Y at the developing position after the trailing edge of the Bk latent image has moved away from the developing position, but before the leading edge of the Y latent image arrives thereat. The Y developing section 231Y then develops the Y latent image with Y toner. The revolver 230 again revolves to locate the C developing section 231C at the developing position after the trailing edge of the Y latent image has moved away from the developing position, but before the leading edge of the next or C latent image arrives at the same. This revolution also completes before the leading edge of the C latent image arrives at the developing position. C and M image forming steps are identical with the Bk and Y image forming steps except for the color and will not be described specifically.

The Bk, Y, C and M toner images sequentially formed on the drum 200 are sequentially transferred to the belt 501 one above the other, completing a full-color image on the belt 501.

At the time when the image forming cycle beings, the sheet P is fed from any one of sheets cassettes 207, sheet cassettes 300*a* through 300*c*, and a manual feed tray 240. The registration roller pair 610 once stops the sheet P fed thereto.

When the leading edge of the full-color toner image on the belt 501 is about to reach the nip between the belt 501 and the bias roller 605 (secondary image transfer position), the registration roller pair 610 drives the sheet P. The leading edge of the sheet P therefore accurately meets the leading edge of the toner image.

The power supply 802 applies the bias for secondary image transfer to the bias roller 605 when the sheet P passes the nip between the belt 501 and the bias roller 605. As a result, the full-color image is transferred from the belt 501 to the sheet P (secondary image transfer). Separating means, not shown, positioned downstream of the secondary image transfer position in the direction of sheet conveyance separates the sheet P off the belt 501 by discharge. Belt conveyors 210 and 211 shown in FIG. 1 sequentially convey the sheet with the full-color image to the fixing device 270. The fixing device 271 and 272 includes a heat roller 271 and a press roller 272. The heat roller 271 and press roller 272 fix the toner image on the sheet P with heat and pressure. An outlet roller pair 212 drives the sheet P with the fixed toner image, or print, out of the copier body to a copy tray, not shown, face up.

The separating means mentioned above is implemented by discharge needles 611 and a bias power supply 803. The discharge needles 611, which constitute a separating member, are positioned such that their tips face the sheet P coming out of the secondary image transfer position. The bias power supply 803 applies a bias to the discharge needles 611 for causing it to separate the sheet P from the belt 501.

The drum cleaner 201 cleans the surface of the drum 200 after the primary image transfer. A quenching lamp, not shown, discharges the cleaned surface of the drum 200. The moving means presses the belt cleaning blade 504 against the belt 501 in order to remove the toner left on the belt 501 after the secondary image transfer.

In a repeat copy mode, after the formation of the first M or fourth-color image, the 1 and printer 2 start forming the second Bk or first-color toner image at a preselected timing. After the secondary transfer of the first full-color image from the belt 501 to the sheet P, the second Bk toner image is transferred from the drum 200 to part of the belt 501 cleaned by the belt cleaning blade 504. This is followed by the sequence of steps described in relation to the first full-color image.

The procedure described above has concentrated on a full-color copy mode. In a tricolor or a bicolor copy mode, the above procedure is repeated a number of times corresponding to the number of colors and the desired number of copies. Further, in a monochromatic copy mode, only the developing section of the revolver 230 corresponding to the desired color is operated while the belt cleaning blade 504 is continuously held in contact with the belt 501.

Figure 3:
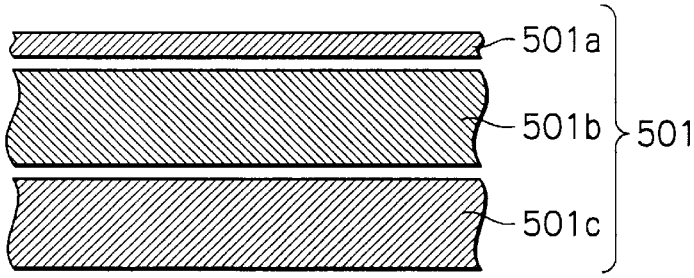
FIG. 3 is a fragmentary section of an intermediate image transfer belt included in the illustrative embodiment.

Hereinafter will be described a specific configuration of the belt 501 and an arrangement for uniforming, before the primary image transfer, the charge (polarization left on the belt 501. As shown in FIG. 3, the belt 501 has a laminate structure having a thickness of 150 m, a width of 368 mm, and an inner circumferential length of 565 mm. The belt 501 moves at a linear velocity of 245 mm/sec by way of example. The laminate structure is made up of an outer layer 501*a* for carrying the toner, an intermediate layer 501*b*, and an inner layer or base layer 501*c*. The outer layer 501*a* and intermediate layer 501*b* have high resistance each. The three layers 501*a* through 501*c* are mainly formed of PVDF. Suitable additives including a conductive material are dispersed in the layers 501*a* through 501*c*.

The outer layer 501*a* has a thickness of 1 $\mu$m and a volume resistivity of $10^{10}$ Ω·cm to $10^{16}$ Ω·cm. The intermediate layer 501*b* has a thickness of about 75 $\mu$m and a volume resistivity ρv of $10^{10}$ Ω·cm to $10^{10}$ Ω·cm. Further, the inner layer 501*c* has a thickness of 75 $\mu$m and a volume resistivity ρv of $10^{8}$ Ω·cm to $10^{11}$ Ω·cm. The resistance of the entire belt 501 is adjusted on the bases of the amount of the conductive material and thickness of each layer.

The materials and configuration of the belt 501 described above are only illustrative. The crux is that the volume resistivity of the entire belt 501 be as high as $10^{10}$ Ω·cm or above.

As for the belt 501 with three layers including high-resistance layers, when a toner image is transferred from the drum 200 to the belt 501, part of a latent image (potential distribution) is also transferred from the drum 200 to the belt 501. When an electric field of about 50 MV/m (field resistance value) is applied to PVDF or similar ferroelectric material, the material automatically polarizes in the opposite direction to the electric field, saturates, and then stabilizes. A voltage of 100 V or above acts on the surface layer 501*a*, which is about 1 $\mu$m thick, and raises the electric field inside the layer 501*a* above the field resistance layer. As a result, the outer layer 501*a* immediately polarizes and then stabilizes. The belt 501 with such a unique surface layer 501*a* can erase, at the time of transfer of a toner image from the drum 200, the potential contrast of the previous latent image and hold the potential contrast of a new latent image on its surface. The potential contrast is essential for reducing the previously discussed toner scattering and obviating a residual image.

However, assume that the same toner image is repeatedly transferred to the same area of the belt 501 as in the full-color copy mode or the repeat copy mode using a single document. Then, the intermediate layer 501*b* below the outer layer 501*a* polarizes and remains in the polarized state for the following reason. At the time of primary image transfer, the strength of the electric field acting on the intermediate layer 501*b* is short of the field resistance value. As a result, the inside of the intermediate layer 501*b* polarizes little by little due to the electric field for primary transfer. The electric field formed in the intermediate layer 501*b* by the above electric field is weaker than the electric field formed in the outer layer 501*a*. It follows that a longer period of time is necessary to cancel or invert the polarization of the intermediate layer 501*b* than to cancel or invert the polarization of the surface layer 501*a*. For details, reference may be made to, e.g., Tajitsu and Furukawa "Basics of Ferroelectrics", Journal of Institute of Electrostatics Japan, Vol. 13, No. 2 (1989), pp. 74–81 and Odajima "Piezoelectricity and Ferroelectricity of Polyvinylidene Fluoride", Journal of The Japan Society of Applied Physics, Vol. 50, No. 12 (1981), pp. 79–83.

For the reason described above, even when a bias implemented by a DC voltage is applied to the belt 501 for discharging it, the intermediate layer 501*b* cannot be easily discharged. On the other hand, assume that a discharging bias implemented by a DC voltage of opposite polarity is applied to the belt 501. Then, the net bias cannot act on the intermediate layer 501*b* because the surface layer 501*a* polarizes soon due to its short time constant of the variation of polarization. Although a high bias may apply a preselected voltage even on the intermediate layer 501*b*, it is undesirable for the surface layer 501*a*.

Figure 4:
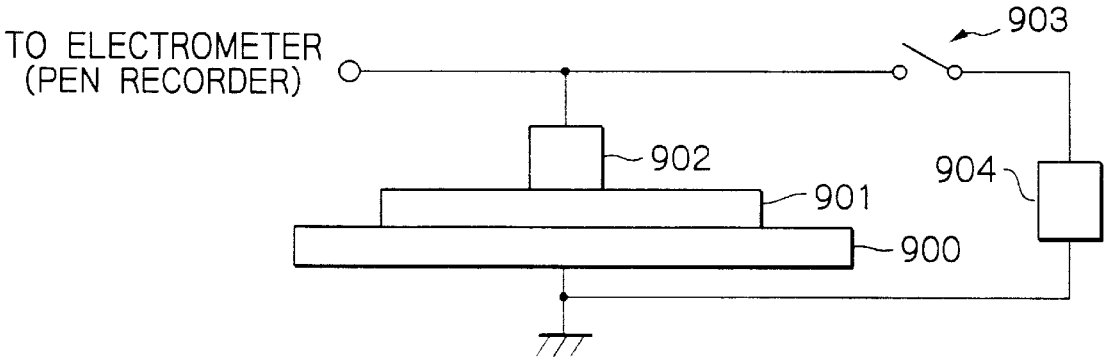
FIG. 4 is a view showing a specific arrangement for measuring a potential left an intermediate image transfer belt formed of PVDF (polyvinylidene fluoride)

FIG. 4 shows a specific arrangement for measuring a potential left on the belt formed of PVDF. As shown, the arrangement includes a conductive base 900 connected to ground. The belt, labeled 901, is laid on the conductive base 900. A probe electrode 902, which is a substitute for the bias roller, is held in contact with the belt 901. An electrometer and a pen recorder, not shown, are connected to the probe electrode 902. In this condition, a switch 903 is operated to apply a bias voltage, which a DC voltage, from a high-tension power supply 904 to the belt 901 via the probe electrode 902. First, a bias of V0 (+250 V or +500 V) for initial saturation polarization is applied to the belt 901, thereby causing polarization to saturate.

Figure 5:
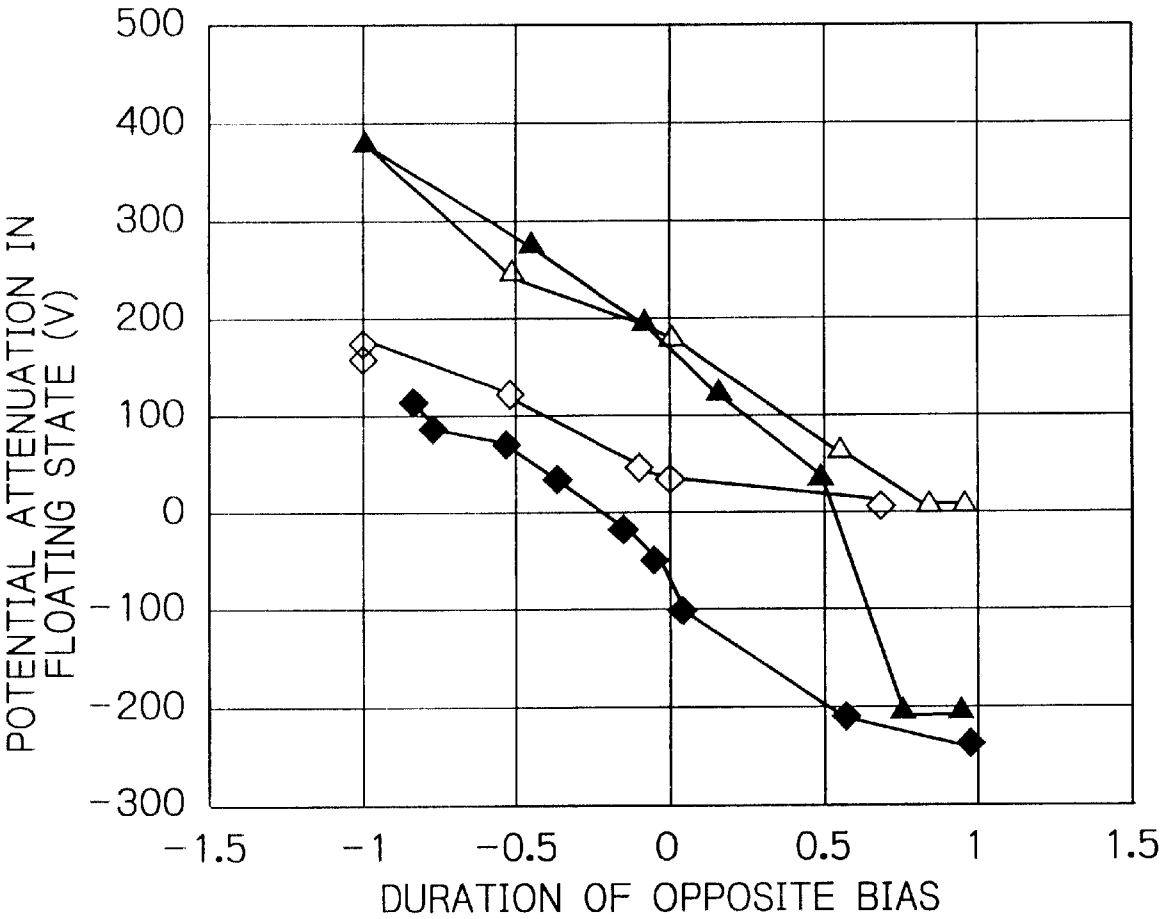
FIG. 5 is a graph showing a relation between the duration of a discharging bias (log T) and the surface potential measured with the arrangement of FIG. 4 on the elapse of a preselected period of time since the application of the above bias.

Subsequently, the switch 903 is operated to bring the belt 901 into a floating state. The electrometer and pen recorder record the resulting attenuation of the surface potential of the belt 901. Usually, an extremely long period of time is necessary for the surface potential to attenuate. Thereafter, a discharging bias of V1 (V) (0V or −250 V) is applied to the belt 901 for a period of time of Δt, which is 0.1 second to 10 seconds. The switch 903 is again operated to bring the belt 901 into a floating state in order to record the attenuation of the surface potential. FIG. 5 plots the surface potential of the belt 901 on the elapse of a preselected period of time, i.e., 6 seconds necessary for the belt to complete one turn.

Specifically, FIG. 5 shows a relation between the duration (log T) of the discharging bias V1 and the surface potential of the belt 901 measured in the preselected period of time (6 seconds) since the application of the discharging bias V1. FIG. 6 lists the various values of the initial bias V0 for saturation and those of the discharging bias V1 derived the data shown in FIG. 5. As shown in FIG. 5, when the bias V0 of +250 V and the bias V1 of −250 V were sequentially applied to the belt 901 in this order, 10 seconds was necessary for the belt 901 to be actually discharged to −250 V. Further, the greater the absolute value of the bias V0 (the higher the initial surface potential of the belt 901 itself) or the higher the potential contrast (the higher the latent image contrast), the longer the discharging time. This probes that it is difficult to discharge the belt 901 to 0 V with the DC voltage after causing the polarization of the belt 901, which is ferroelectric, to saturate.

As stated above, even after the surface potential of the belt 901 has been discharged to 0 V, polarization corresponding to the potential contrast of the previous toner image remains in the intermediate layer 501*b*. This is also true when the surface layer 901*a* is formed of a material other than PVDF because of the tunnel effect particular to a thin layer. Consequently, it is difficult to discharge the belt 501 including the high-resistance intermediate layer 501*b* with a DC voltage. While a high AC bias with a great amplitude may surely discharge the entire laminate of the belt 501, it not only increases the power supply cost, but is apt to bring about damage to the belt 501 and cause banding to appear in an image. Moreover, discharge using an AC bias must be accompanied by postprocessing to deal with ozone.

In light of the above, the illustrative embodiment uniforms polarization left in the high-resistance intermediate layer 501*b* while maintaining its polarity. This is done after the belt 501 has started moving at the beginning of an image forming operation, but before the primary transfer of a toner image from the drum 200 to the belt 501. Uniforming the polarization of the intermediate layer 501*b* is successful to reduce the potential contrast left in the belt 501 for thereby obviating a residual image. Particularly, by applying a pre-bias to the belt 501 in a direction in which the polarization of the intermediate layer 501*b* saturates, it is possible to more rapidly, easily reduce the potential contrast.

Figure 7:
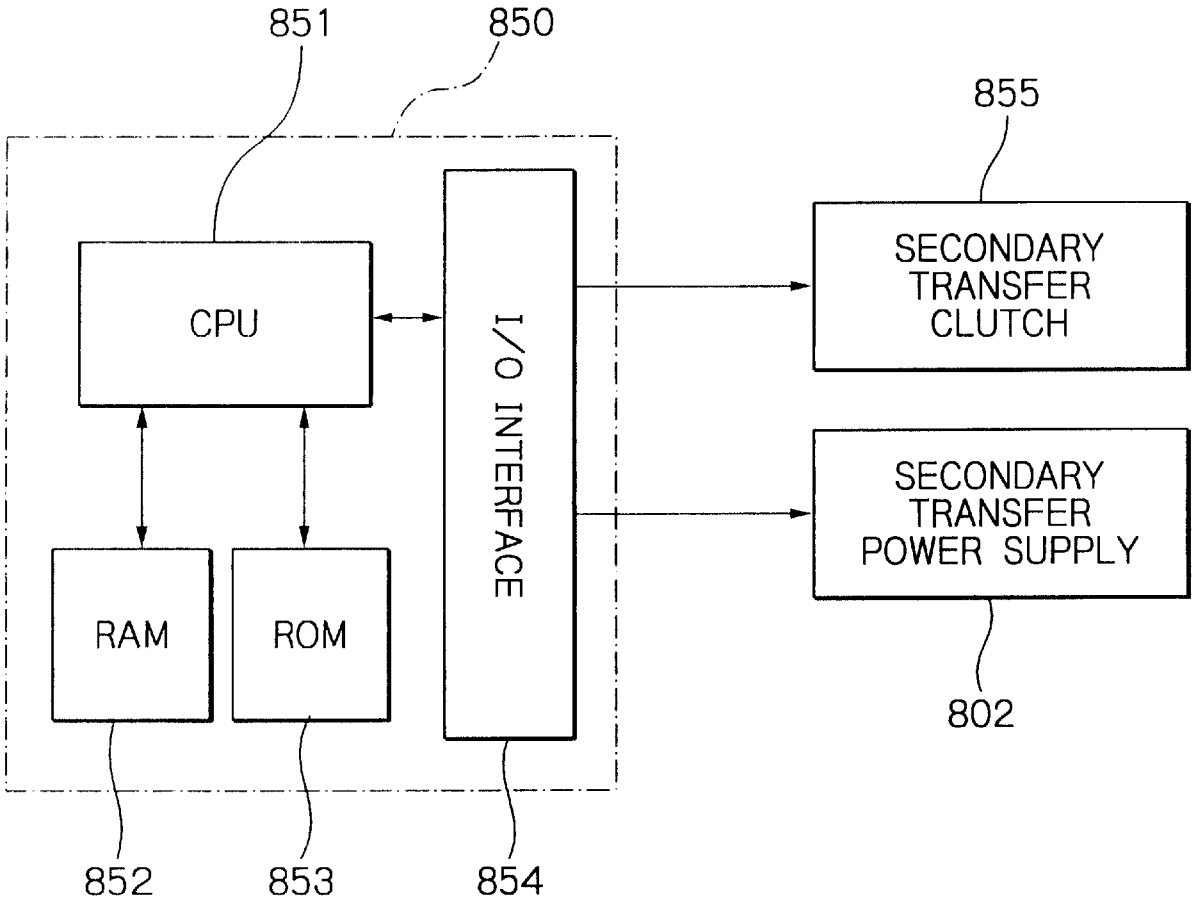
FIG. 7 is a schematic block diagram showing essential part of a control system included in the illustrative embodiment.

Specifically, in the illustrative embodiment, the secondary image transferring device 600 plays the role of polarization uniforming means at the same time. FIG. 7 shows major part of a control system for controlling the secondary image transferring device 600 to apply the pre-bias. As shown, the sequence controller mentioned earlier, labeled 850, includes a CPU (Central Processing Unit) 851, a RAM (Random Access Memory) 852, a ROM (Read Only Memory) 853, and an I/O (Input/Output) interface 854. A secondary image transfer clutch 855 and the power supply 802 for secondary image transfer are connected to the sequence controller 850 via the I/O interface 854.

Figure 8:
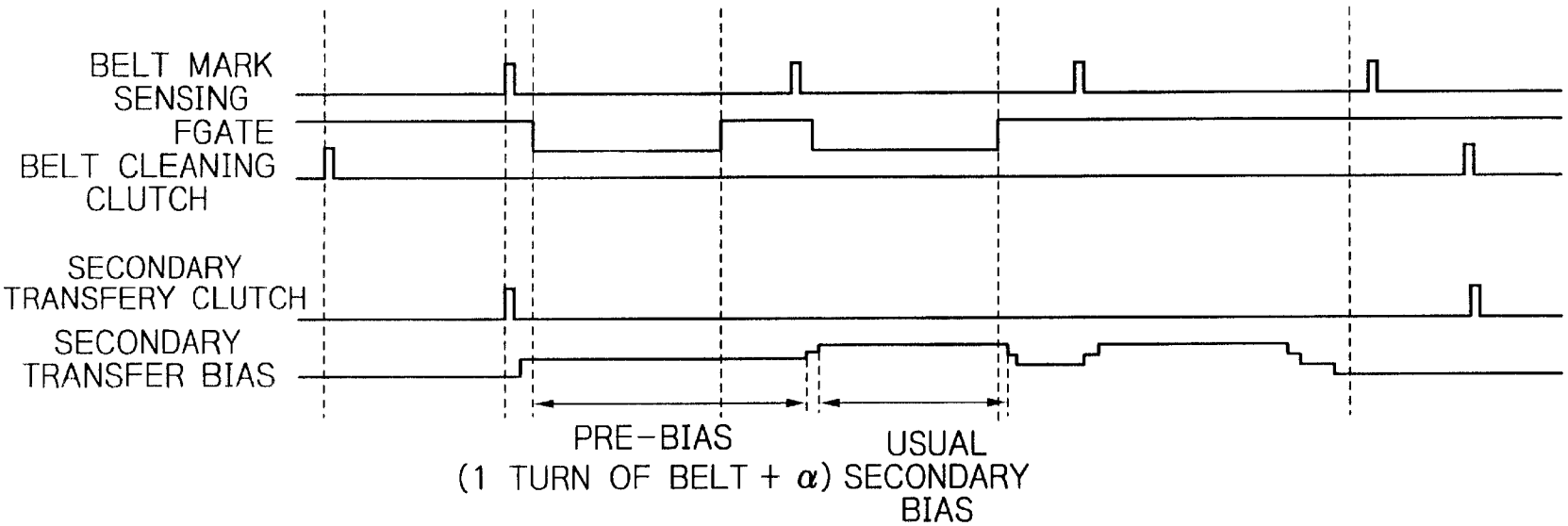
FIG. 8 is a timing chart demonstrating a specific operation of the illustrative embodiment.

FIG. 8 demonstrates a specific image forming operation including the control over the application of the pre-bias. The specific operation sequentially forms two monochromatic toner images of different colors on the belt 501 one after the other within the circumferential length of the belt 501. The toner images are transferred to sheets P of size A3 one after the other. A halftone image with low image density (ID) is transferred to the second sheet P.

As shown in FIG. 8, after a copy button, for example, has been pressed to cause the drum 200 and belt 501 to start moving, a belt cleaning clutch is coupled to cause the belt cleaning blade 504 to start cleaning the belt 501. As soon as the optical sensor 514 senses the mark provided on the belt 501, the sequence controller 850 couples the secondary image transfer clutch 855 and thereby brings the bias roller 605 into contact with the belt 501. At the same time, the sequence controller 850 causes the power supply 802 to apply the pre-bias (e.g. +70 $\mu$A), which is current controlled, to the bias roller 605. The pre-bias starts uniforming the polarization of the intermediate layer 501*b*. On the elapse of a preselected period of time since the detection of the mark, FGATE signals corresponding to the consecutive images are sequentially output.

When at least a period of time necessary for the belt 501 to complete one turn expires, the pre-bias is replaced with a usual bias for secondary image transfer (e.g. +40 $\mu$A) to sequentially transfer the two toner images from the belt 501 to two sheets P.

With the procedure described above, the illustrative embodiment uniforms polarization left in the intermediate layer 501*b* for thereby canceling a potential contrast left in the layer 501*b*. This successfully obviates a residual image ascribable to polarization left in the intermediate layer 501*b* by the previous image forming cycle. Particularly, uniforming polarization while maintaining the polarity of polarization uniforms the polarization more rapidly and more easily than uniforming it by canceling polarization left in the intermediate layer 501*b* or inverting the polarity thereof.

FIG. 9 compares the illustrative embodiment and a comparative example with respect to a residual image rank determined by varying the pre-bias. The comparative example did not apply the pre-bias. A residual image was estimated at two positions in five ranks; the greater the numerical value, the lower the degree of a residual image, i.e., the higher the image quality. As FIG. 9 indicates, when the pre-bias is 40 $\mu$A or above, high image quality belonging to residual image rank 3.5 or above is achievable.

Further, before the primary transfer of the first toner image to the first sheet P, the illustrative embodiment uniforms polarization left in the intermediate layer 501*b*. As a result, a residual image ascribable to polarization left in the intermediate layer 501*b* at the time of the secondary transfer of the first toner image appears little in the second toner image transferred to another area of the belt 501. This will be described specifically with reference to FIGS. 10A through 10C.

Figure 10A:
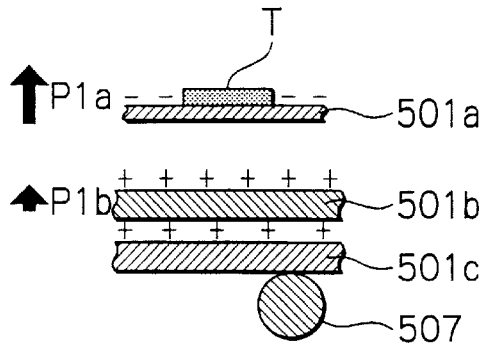
FIGS. 10A through 10C are views for describing how the pre-bias obviates a residual image.
Figure 10B:
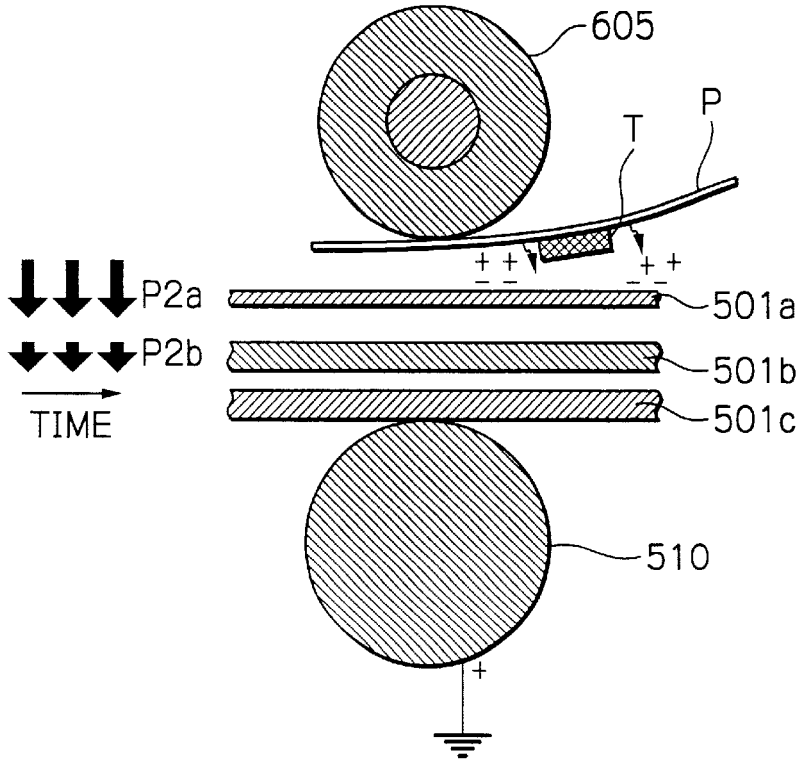
Figure 10C:
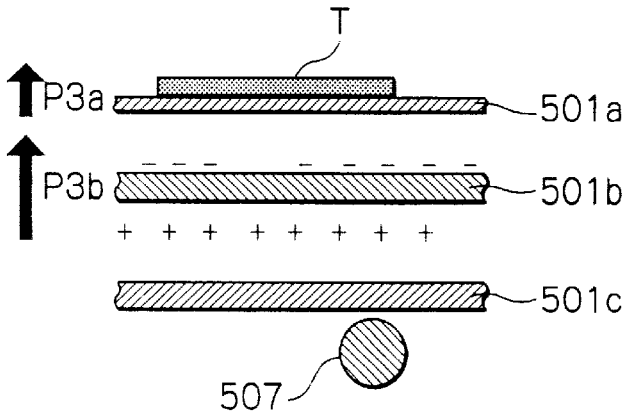

FIGS. 10A, 10B and 10C respectively demonstrate the primary transfer of the first toner image from the drum 200 to the belt 501, the secondary transfer of the same image from the belt 501 to the sheet P, and the primary transfer of the second toner image. The three layers 501*a* through 510*c* of the belt 510 are shown as being separate from each other for the sake of illustration. Arrows P1*a*, P2*a* and P3*a* indicate the directions and sizes of polarization of the outer layer 501*a*. Likewise, arrows P1*b*, P2*b* and P3*b* indicate the directions and sizes of polarization of the intermediate layer 501*b*.

As shown in FIG. 10*a*, a relatively great amount of negative true charge is present on the background portion of the outer side (top in the figure) of the outer layer 501*a* due to the background potential VD of the drum 200. Also, a relatively small amount of negative charge is present at a toner portion T on the same side of the outer layer 501*a*. At this instant, the pre-bias effected beforehand injects positive true charge into the belt 501 via the outer layer 501*b* beforehand, causing downward polarization, as viewed in the figure, to occur in the intermediate layer 501*b*.

Therefore, even the bias for primary transfer (positive) applied to the bias roller 507 causes only a small potential difference to act on the intermediate layer 501*b*. Consequently, the polarization P1*b* directed upward, as viewed in the figure, is smaller than conventional one.

Subsequently, as shown in FIG. 10B, the polarization of the outer layer 501*a* immediately inverts due to the secondary transfer of the first toner image. This, coupled with the fact that the upward polarization P1*b* is small, causes the polarization of the intermediate layer 501*b* to invert, too. As a result, the polarization P2*b*, which is relatively small and directed downward, occurs.

As shown in FIG. 10C, on the primary transfer of the second toner image, the polarization of the intermediate layer 501*b* resulting from the bias (positive) applied to the bias roller 507 is reduced because the positive true charge deposited by the secondary transfer still remains on the upper side of the intermediate layer 501*b*. In this manner, although the polarization derived from the first toner image is left in the intermediate layer 501*b*, the size of the polarization is smaller than the conventional size and therefore effects the primary transfer little. This successfully prevents the transfer ratio from varying, i.e., prevents the first toner image from appearing in the second toner image as a residual image.

Figure 11A:
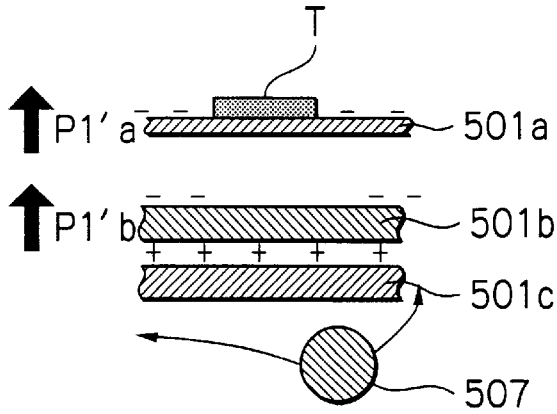
FIGS. 11A through 11C are views demonstrating a mechanism in which a comparative example causes a residual image to appear.
Figure 11B:
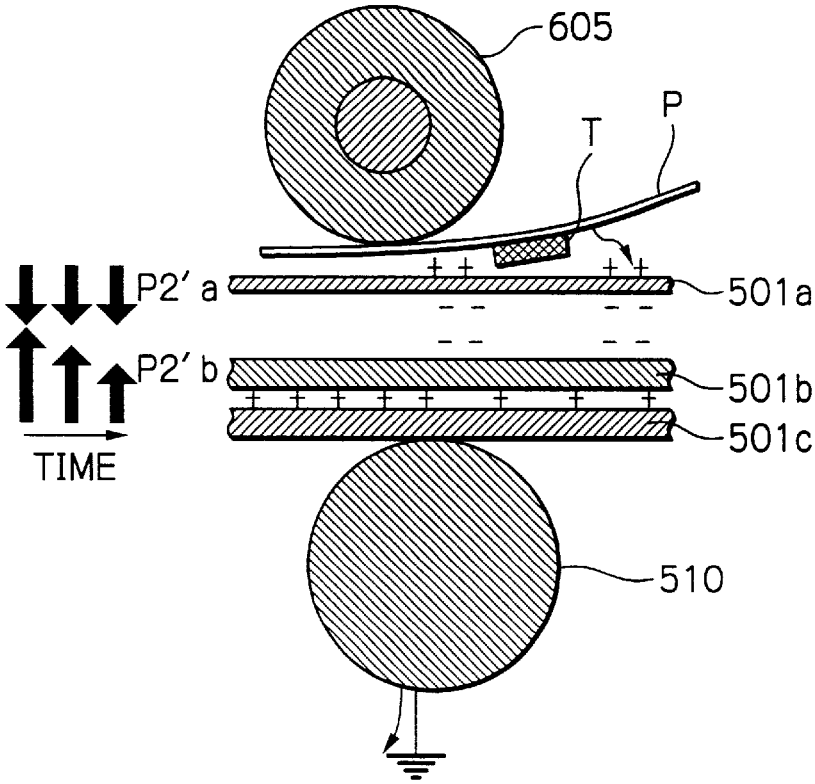
Figure 11C:
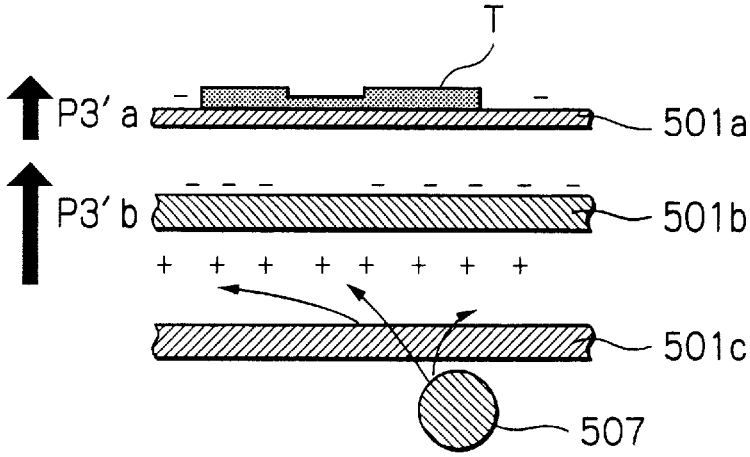

FIGS. 11A through 11B pertain to the comparative example not using the pre-bias and respectively show the primary transfer of the first toner image, the secondary transfer of the same image, and the primary transfer of the second toner image. As shown in FIG. 11A, downward polarization is absent in the intermediate layer 501*b*. Therefore, polarization P1*b*' more intense than in the illustrative embodiment occurs in the intermediate layer 501*b* due to the primary transfer of the first toner image. As a result, as shown in FIG. 11B, although the secondary transfer of the first toner image inverts the polarization P2*a*' in the outer layer 501*a*, it does not invert the polarization P2*b*' in the intermediate layer 501*b*. The polarization P2*b*' therefore remains in the intermediate layer 501*b* although slightly decreasing. Subsequently, as shown in FIG. 11C, the primary bias (positive) applied to the bias roller 507 for the primary transfer of the second toner image further intensifies the polarization P3*b*' in the intermediate layer 501*b*. Such intense polarization P3*b*' remaining in the intermediate layer 501*b* causes the first toner image appear in the second toner image as a residual image.

In the illustrative embodiment, the pre-bias is subjected to constant-current control. Therefore, even when the resistance of the belt 501 varies, the intermediate layer 501*b* can evenly polarize to preselected intensity. Because the secondary image transferring device 600 plays the role of polarization uniforming means at the same time, the copier is low cost and small size. The current value of the pre-bias should preferably be equal to or greater than the current value of the bias for secondary image transfer. This successfully enhances the effect of charge injection in the belt 501 for thereby more surely uniforming the polarization of the intermediate layer 501*b*.

Assume that the pre-bias is applied for a period of time corresponding to one and half turns of the belt 501 by way of example. Then, a step occurs in the polarization of the intermediate layer 501*b* and causes a strip-like defect appear in the resulting image. To solve this problem, the duration of the pre-bias should preferably be an integral multiple of a period of time corresponding to one turn of the belt 501.

Figure 12:
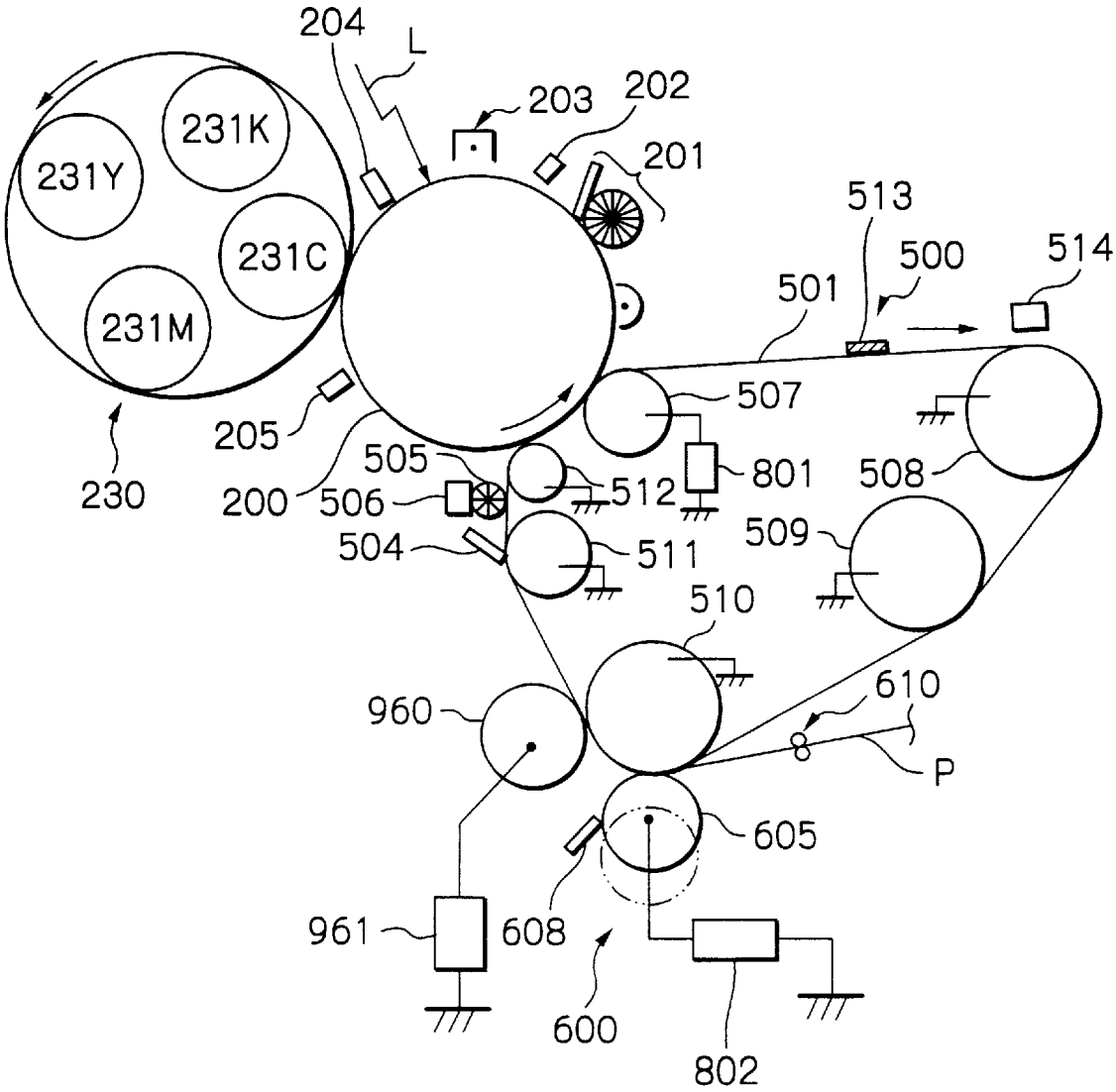
FIG. 12 is a front view showing a modification of the illustrative embodiment.

FIG. 12 shows a modification of the illustrative embodiment. As shown, an exclusive bias roller 960 for the pre-bias is positioned downstream of the secondary image transferring device 600 in the direction of rotation of the belt 501. The bias roller 960 is held in contact with the roller 510 with the intermediary of the belt 510. A power supply 961 applies the pre-bias controlled to a preselected current to the bias roller 960. The bias roller 960 is simpler in configuration and lower in cost than the relatively expensive bias roller for secondary image transfer used in the illustrative embodiment.

In the modification shown in FIG. 12, the bias roller 960 should preferably have medium electric resistance, so that the current does not concentrate when the film of the belt 501 is defective. The kind of conductivity for providing the bias roller 960 with medium resistance may be implemented by either one of electronic conduction and ion conduction. A moving mechanism, not shown, selectively moves the bias roller 960 into or out of contact with the belt 501. The moving means may bring the bias roller 960 into contact with the belt 501 at the same time when the belt cleaning blade 504 contacts the belt 501.

Figure 13:
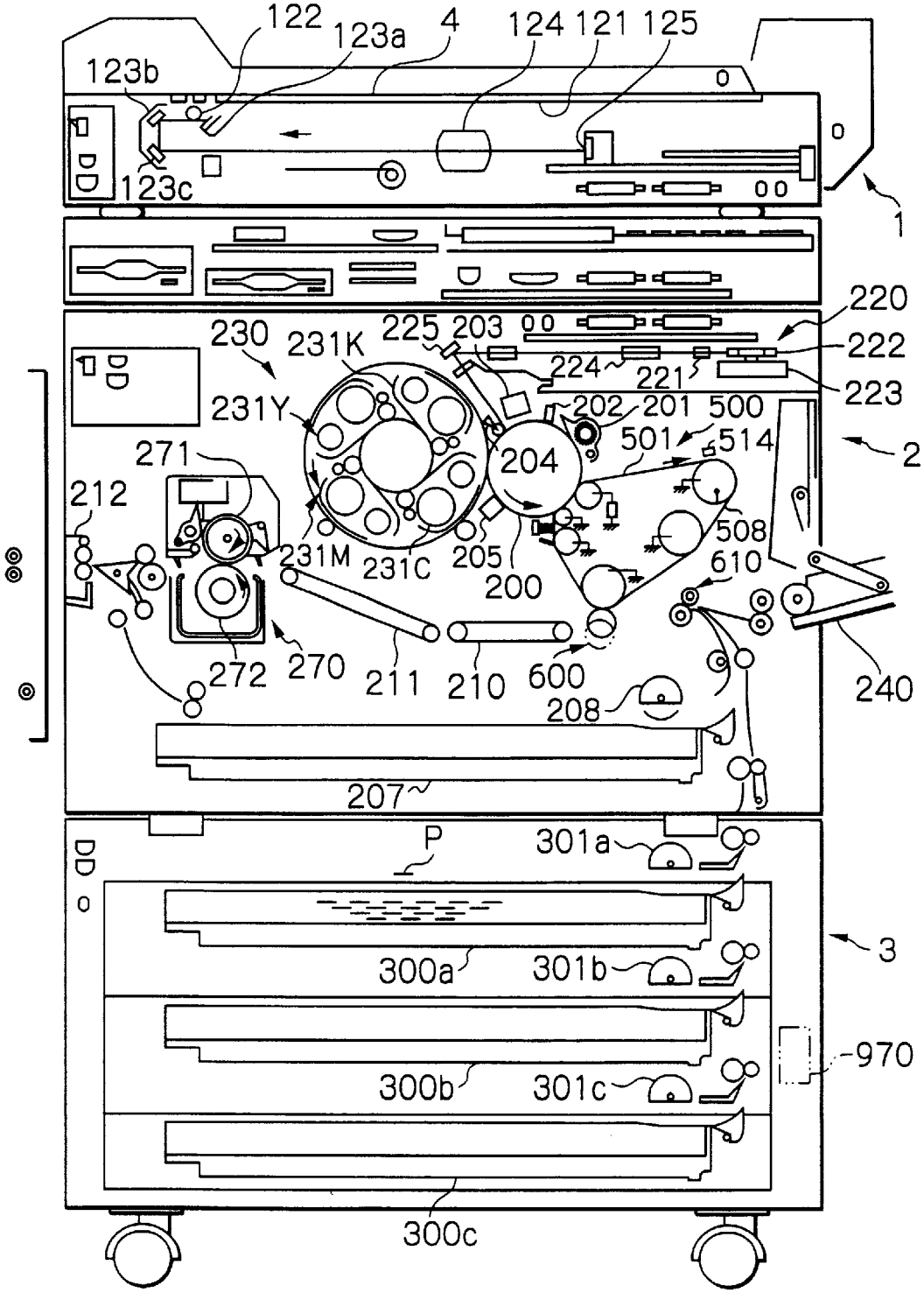
FIG. 13 is a front view showing another modification of the illustrative embodiment.

In the illustrative embodiment, the material of the belt 501 varies in electric resistance by the order of one figure because it is susceptible to humidity. Therefore, in a low temperature, low humidity environment, the current of the pre-bias adequate in a normal temperature, normal humidity environment may be excessively high in a normal temperature, normal humidity atmosphere. FIG. 13 shows another modification of the illustrative embodiment additionally including a humidity sensor or humidity sensing means 970. The humidity sensor 970 is responsive to absolute humidity inside of the copier. The current of the pre-bias is switched in accordance with absolute humidity sensed by the humidity sensor 970. For example, when absolute humidity decreases below a preselected reference value (low temperature, how humidity environment), the current of the pre-bias switched to a smaller value. More specifically, the current of the pre-bias is set at 70 $\mu$A in a normal temperature, normal humidity environment and set at 50 A in a low temperature, low humidity environment in which absolute humidity is lower than 4.7 g/m$^3$.

The illustrative embodiment additionally includes a duplex-copy unit 207 for forming images on both sides of the sheet P. Specifically, the sheet P carrying an image on one side or first side thereof and come out of the fixing device 270 is steered to the duplex-copy unit 207. A pickup roller 208 again pays out the sheet P toward the image forming section, so that another image is formed on the other side or second side of the sheet P. In this case, the electric resistance of the sheet P differs from the time when an image formed on one side, but is not fixed, to the time when an image formed on the other side after the fixation of the image on one side.

On the other hand, at the secondary image transferring station, the bias for secondary image transfer is divided with the result that a potential difference acts on the sheet P. This potential difference, i.e., the strength of electric field acting on the sheet P is dependent on the electric characteristic of the sheet P. Consequently, for a given bias for secondary transfer, the strength of electric field to act on the sheet P differs from the time when an image is formed on one side of the sheet P, but is not fixed, to the time when an image formed on the other side after the fixation of the image on the first side.

In light of the above, the pre-bias may apply a particular bias to each of the transfer of an image to the first side of the sheet P and the transfer of an image to the second side of the same sheet P. More particularly, a current of 70 μA and a current of 30 μA or below may be respectively assigned to the transfer of an image to the first side of the sheet P and the transfer of an image to the second side of the sheet P.

While the illustrative embodiment has concentrated on a color copier, the present invention is similarly applicable to any other image forming apparatus, e.g., a monochromatic copier, a printer or a facsimile apparatus. This is also true with an alternative embodiment to be described later.

As stated above, the illustrative embodiment achieves various unprecedented advantages, as enumerated below.

(1) The illustrative embodiment can uniform polarization left in a high-resistance layer more rapidly and more easily that an apparatus of the type canceling or inverting the polarity of such polarization. Therefore, even when use is made of an intermediate image transfer body including a high-resistance layer, which desirably obviates toner scattering, a residual image ascribable to polarization left before primary image transfer can be surely obviated. This is true even when the electric resistance of the intermediate image transfer body is irregular.

(2) Polarization can be uniformed more efficiently because the polarization of the high-resistance layer polarizes in a single direction.

(3) The distribution of polarization of the high-resistance layer does not include a step. This more surely obviates a residual image ascribable to the polarization left in the high-resistance layer.

(4) Even when humidity varies, the polarization of the high-resistance layer is increased to a preselected size, insuring desirable secondary image transfer.

(5) In a duplex print mode, the size of the polarization is adjusted with respect to the first and second sides of a sheet, so that desirable image transfer can be effected with both sides of the sheet.

(6) The illustrative embodiment reduces the cost and size of an image forming apparatus.

An alternative embodiment of the present invention, which is mainly directed toward the second object mentioned earlier, will be described hereinafter. The illustrative embodiment is also constructed and operated as described with reference to FIGS. 1 and 13. Description made with reference to FIGS. 2 through 7, 10A through 10C, 11A through 11C and 12 also applies to the illustrative embodiment and will not be described specifically in order to avoid redundancy.

In the illustrative embodiment, at the end of an image forming operation, polarization left in the intermediate or high-resistance layer 501*b* is uniformed while preserving its polarity after the secondary image transfer, but before the stop of movement of the belt 501. This successfully reduces potential contrast left in the belt 501 to thereby obviate a residual image at the time of the next image forming operation. Particularly, a post-bias is applied in a direction in which the polarization of the intermediate layer 501*b* saturates, so that the potential contrast rapidly, easily decreases.

Figure 14:
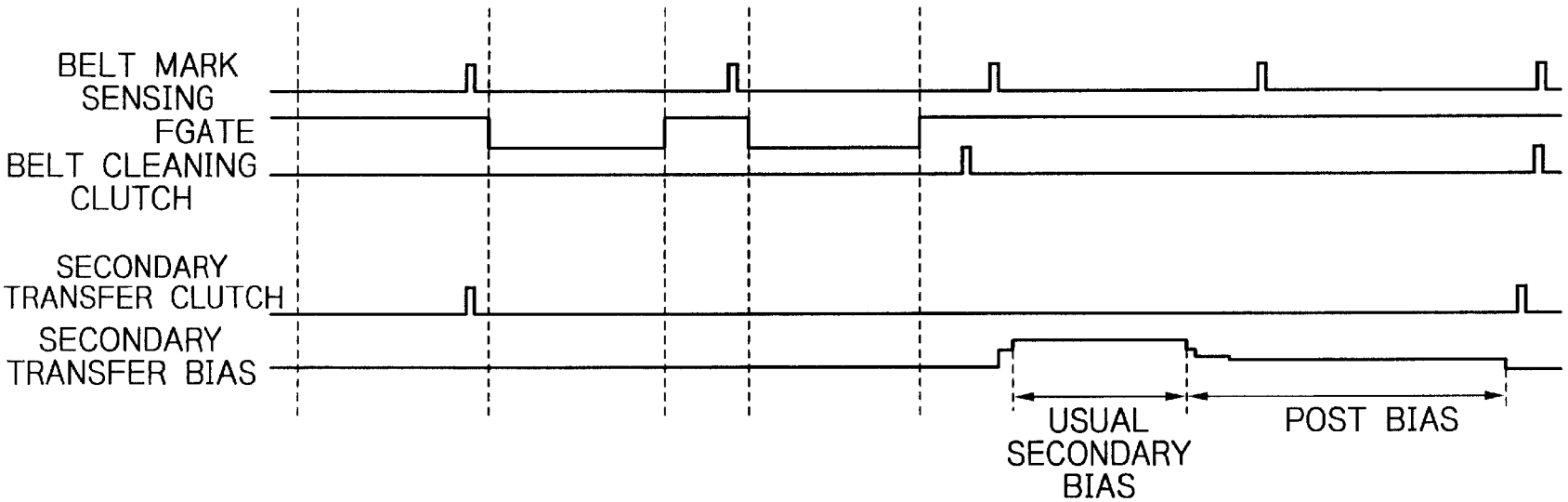
FIG. 14 is a timing chart demonstrating a specific operation of an alternative embodiment of the present invention.

FIG. 14 shows a specific image forming procedure including the application of the post-bias. The procedure assumes that toner images of different colors are sequentially formed on the belt 501 within the circumferential length of the belt 501 and sequentially transferred to consecutive sheets P of size A3.

As shown in FIG. 14, after a copy button, for example, has been pressed to cause the drum 200 and belt 501 to start moving, a belt cleaning clutch is coupled to cause the belt cleaning blade 504 to start cleaning the belt 501. After the optical sensor 514 has sensed the mark provided on the belt 501, FGATE signals corresponding to the consecutive images are sequentially output. Subsequently, the usual bias for secondary transfer is replaced with the post-bias (e.g. +30 μA). The post-bias uniforms polarization left in the intermediate layer 501*b* while preserving its polarity, thereby canceling potential contrast ascribable to the polarization. It follows that the next image formation to be effected later is free from a residual image otherwise brought about by polarization left in the intermediate layer 501*b*.

Particularly, in a full-color copy mode, toner images are sequentially formed on the drum 200 and then transferred to the belt 501 with the mark on the belt 501 being sensed toner image by toner image. Therefore, the toner images of the same size, but different in color, are transferred to the same area of the belt 501, so that potential contrast ascribable to polarization is apt to increase. The post-bias unique to the illustrative embodiment uniforms the above polarization left in the intermediate layer 501*b* to thereby obviate a residual image at the next image formation to be effected layer.

Further, the illustrative embodiment uniforms the polarization of the intermediate layer 501*b* while preserving the polarity provided by the bias for secondary image transfer applied immediately before. This rapidly, easily uniforms the polarization left in the intermediate layer 501*b*, compared to the case wherein the polarization is canceled or inverted in polarity.

FIG. 15 compares the illustrative embodiment and a comparative example with respect to a residual image rank determined by varying the post-bias. The comparative example did not apply the post-bias. A residual image was estimated in five ranks; the greater the numerical value, the lower the degree of a residual image, i.e., the higher the image quality. As FIG. 15 indicates, when the post-bias is 30 μA or above, which is 60% of the current of the usual bias for secondary transfer or above, high image quality belonging to residual image rank 3.5 or above is achievable.

Assume that the post-bias is applied for a period of time corresponding to one and half turns of the belt 501 by way of example. Then, a step occurs in the polarization of the intermediate layer 501*b* and causes a strip-like defect appear in the resulting image. To solve this problem, the duration of the post-bias should preferably be an integral multiple of a period of time corresponding to one turn of the belt 501.

Generally, potential contrast ascribable to polarization to remain in the intermediate layer 501*b* at the end of an image forming operation increases with an increase in the number of toner images sequentially transferred to the same area of the belt 501 one above the other. In light of this, the sequence controller 850, FIG. 7, may selectively turn on or turn off the post-bias in accordance with the number of toner images transferred to the same area of the belt 501 one above the other.

For example, in a black-and-white or similar monochromatic mode, potential contrast ascribable to polarization left in the intermediate layer 501*b* is low. In this mode operation, the sequence controller 850 turns off the post-bias after the secondary image transfer. On the other hand, in a bicolor or a full-color mode in which the above potential contrast is high, the sequence controller 850 turns on the post-bias because the potential contrast tends to increase.

With the selective application of the post-transfer, the sequence controller 850 not only obviates a residual image at the next image formation, but also avoids wasteful application of the post-bias to thereby prevent productivity from decreasing.

Potential contrast ascribable to polarization left in the intermediate layer 510 at the end of an image forming operation tends to increase with an increase in the number of sheets to which the same image is transferred as well. In light of this, the sequence controller 85 may count the sheets P to which the same image is transferred by a sequence of image forming cycles and selectively turn on or turn off the post-bias in accordance with the count. For example, when the same color image is transferred to four sheets P or less, the sequence controller 850 turns off the post-bias because potential contract is relatively low. On the other hand, the number of sheets P to which the same color image transferred is five or more, the sequence controller 850 turns on the post-bias because potential contrast tends to increase. With this scheme, too, the sequence controller 850 not only obviates a residual image at the next image formation, but also avoids wasteful application of the post-bias to thereby prevent productivity from decreasing.

As stated above, the illustrative embodiment achieves various unprecedented advantages in addition to the advantages of the previous embodiment. The illustrative embodiment can uniform polarization left in a high-resistance layer after an image forming operation more rapidly and more easily that an apparatus of the type canceling or inverting the polarity of such polarization. Therefore, even when use is made of an intermediate image transfer body including a high-resistance layer, which desirably obviates toner scattering, a residual image ascribable to polarization left after an image forming operation can be surely obviated. This is true even when the electric resistance of the intermediate image transfer body is irregular. In addition, the illustrative embodiment not only obviates the residual image, but also avoids wasteful application of a post-transfer and thereby prevents productivity from decreasing.

Various modifications will become possible for those skilled in the art after receiving the teachings of the present disclosure without departing from the scope thereof.

What is claimed is:

1. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at a beginning of an image forming operation, polarization left in said high-resistance layer while preserving a polarity of said polarization after the surface of said intermediate image transfer body has started moving, but before the toner image is transferred from said image carrier to said intermediate transfer body;

wherein said secondary image transferring means also constitutes said polarization uniforming means.

2. The apparatus as claimed in claim 1, wherein said polarization uniforming means comprises:

a member facing said intermediate transfer body; and pre-bias applying means for applying a pre-bias subjected to constant-current control to said member.

3. The apparatus as claimed in claim 2, wherein said intermediate image transfer body comprises an endless belt, and said pre-bias is applied for a preselected period of time that is an integral multiple of a period of time necessary for said endless belt to complete one fill turn.

4. The apparatus as claimed in claim 2, further comprising turning means for turning the recording medium which carries a toner image on a first side thereof, to thereby cause a second side of said recording medium to face said intermediate image transfer body such that a toner image is transferred to said second side, wherein said pre-bias applied differs from said first side to said second side.

5. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at an end of an image forming operation, polarization left in said high-resistance layer while preserving a polarity of said polarization after a toner image has been transferred from said intermediate image transfer body to the recording medium, but before the surface of said intermediate image transfer body stops moving;

wherein said secondary image transferring means also consistutes said polarization uniforming means.

6. The apparatus as claimed in claim 5, wherein said polarization uniforming means comprises:

a member facing said intermediate transfer body; and post-bias applying means for applying a post-bias subjected to constant-current control to said member.

7. The apparatus as claimed in claim 6, wherein said intermediate image transfer body comprises an endless belt, and said post-bias is applied for a preselected period of time that is an integral multiple of a period of time necessary for said endless belt to complete one full turn.

8. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at a beginning of an image forming operation, polarization left in said high-resistance layer while preserving a polarity of said polarization after the surface of said intermediate image transfer body has started moving, but before the toner image is transferred from said image carrier to said secondary image transfer body;

wherein said polarization uniforming means comprises:

a member facing said intermediate transfer body; and pre-bias applying means for applying a pre-bias subjected to a constant-current control to said member;

wherein said secondary image transferring means also constitutes said polarization uniforming means.

9. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at a beginning of an image forming operation, polarization left in said high-resistance layer while preserving a polarity of said polarization after the surface of said intermediate image transfer body has started moving, but before the toner image is transferred from said image carrier to said secondary image transfer body;

wherein said polarization uniforming means comprises:

a member facing said intermediate transfer body; and pre-bias applying means for applying a pre-bias subjected to constant-current control to said member;

wherein said secondary image transferring means comprises:

a secondary image transfer member facing said intermediate image transfer body; and secondary image transfer bias applying means for applying a bias for secondary image transfer subjected to constant-current control to said member;

wherein a set current value of said pre-bias is greater than a set current value of the bias for secondary image transfer.

10. The apparatus as claimed in claim 9, wherein said secondary image transferring means also constitutes said polarization uniforming means.

11. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at a beginning of an image forming operation, polarization left in said high-resistance layer while preserving a polarity of said polarization after the surface of said intermediate image transfer body has started moving, but before the toner image is transferred from said image carrier to said secondary image transfer body;

wherein said polarization uniforming means comprises:

a member facing said intermediate transfer body; and pre-bias applying means for applying a pre-bias subjected to constant-current control to said member;

wherein said intermediate image transfer body comprises an endless belt, and said pre-bias is applied for a preselected period of time that is an integral multiple of a period of time necessary for said endless belt to complete one full turn;

wherein said secondary image transferring means also constitutes said polarization uniforming means.

12. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at a beginning of an image forming operation, polarization left in said high-resistance layer while preserving a polarity of said polarization after the surface of said intermediate image transfer body has started moving, but before the toner image is transferred form said image carrier to said secondary image transfer body;

wherein said polarization uniforming means comprises:

a member facing said intermediate transfer body; and pre-bias applying means for applying a pre-bias subjected to constant-current control to said member;

further comprising:

humidity sensing means for sensing humidity; and control means for controlling said pre-bias applying means to thereby vary said pre-bias in accordance with an output of said humidity sensing means.

13. The apparatus as claimed in claim 12, where in said secondary image transferring means also constitutes said polarization uniforming means.

14. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at a beginning of an image forming operation, polarization left in said high-resistance layer while preserving a polarity of said polarization after the surface of said intermediate image transfer body has started moving, but before the toner image is transferred from said image carrier to said secondary image transfer body;

wherein said polarization uniforming means comprises:

a member facing said intermediate transfer body; and pre-bias applying means for applying a pre-bias subjected to constant-current control to said member;

further comprising turning means for turning the recording medium which carries a toner image on a first side thereof, to thereby cause a second side of said recording medium to face said intermediate image transfer body such that a toner image is transferred to said second side, wherein said pre-bias applied differs from said first side to said second side;

wherein said secondary image transferring means also constitutes said polarization uniforming means.

15. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at an end of an image forming operation, polarization left in said high-resistance layer while preserving a polarity of said polarization after a toner image has been transferred from said intermediate image transfer body to the recording medium, but before the surface of said intermediate image transfer body stops moving;

wherein said polarization uniforming means comprises:

a member facing said intermediate transfer body; and post-bias applying means for applying a post-bias subjected to constant-current control to said member;

wherein said secondary image transferring means also constitutes said polarization uniforming means.

16. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at an end of an image forming operation, polarization left in said high-resistance layer while preserving a polarity of said polarization after a toner image has been transferred from said intermediate image transfer body to the recording medium, but before the surface of said intermediate image transfer body stops moving;

wherein said polarization uniforming means comprises:

a member facing said intermediate transfer body; and post-bias applying means for applying a post-bias subjected to constant-current control to said member;

wherein said secondary image transferring means comprises:

a member facing said intermediate image transfer body; and a secondary image transfer bias applying means for applying a bias for secondary image transfer subjected to a constant-current control to said member;

wherein a set current value of said post-bias is 60% of a set current value of the secondary image transfer bias or above.

17. The apparatus as claimed in claim 16, wherein said secondary image transferring means also constitutes said polarization uniforming means.

18. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at an end of an image forming operation, polarization left in said high-resistance layer while preserving a polarity of said polarization after a toner image has been transferred from said intermediate image transfer body to the recording medium, but before the surface of said intermediate image transfer body stops moving;

wherein said polarization uniforming means comprises:

a member facing said intermediate transfer body; and post-bias applying means for applying a post-bias subjected to constant-current control to said member;

wherein said intermediate image transfer body comprises an endless belt, and said post-bias is applied for a preselected period of time that is an integral multiple of a period of time necessary for said endless belt to complete one full turn;

wherein said secondary image transferring means also constitutes said polarization uniforming means.

19. An image forming apparatus comprising:

an image carrier;

latent image forming means for forming a latent image on said image carrier;

developing means for developing the- latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at an end of an image forming operation, polarization left in said high-resistance layer while preserving a polarity of said polarization after a toner image has been transferred from said intermediate image transfer body to the recording medium, but before the surface of said intermediate image transfer body stops moving;

wherein said polarization uniforming means comprises:

a member facing said intermediate transfer body; and post-bias applying means for applying a post-bias subjected to constant-current control to said member;

further comprising control means for controlling said post-bias applying means to thereby selectively turn on or turn off said post-bias in accordance with a number of toner images transferred to a same area of the said intermediate image transfer body one above the other.

20. The apparatus as claimed in claim 19, wherein said secondary image transferring means also constitutes said polarization uniforming means.

21. An image forming apparatus comprising:

an image carrier;

latent image forming means for forming a latent image on said image carrier;

developing means for developing the latent image with toner to thereby form a corresponding toner image;

an intermediate image transfer body having a movable surface and including an high-resistance layer whose volume resistivity is $10^{10}$ Ω·cm or above;

primary image transferring means for transferring the toner image from said image carrier to said intermediate image transfer body;

secondary image transferring means for transferring the toner image from said intermediate image transfer body to a recording medium; and polarization uniforming means for uniforming, at an end of an image forming operation, polarization left in said high-resistance layer while preserving a polarity of said polarization after a toner image has been transferred from said intermediate image transfer body to the recording medium, but before the surface of said intermediate image transfer body stops moving;

wherein said polarization uniforming means comprises:

a member facing said intermediate transfer body; and post-bias applying means for applying a post-bias subjected to constant-current control to said member;

further comprising control means for controlling said post-bias applying means to thereby selectively turn on or turn off said post-bias in accordance with a number of recording media to which a same image is transferred by a sequence of image forming cycles.

22. The apparatus as claimed in claim 21, wherein said secondary image transferring means also constitutes said polarization uniforming means.

* * * * *